United States Patent [19]

Scribner

[11] 4,261,238

[45] Apr. 14, 1981

[54] PNEUMATIC STOCK FEEDER FOR PUNCH PRESSES AND THE LIKE

[76] Inventor: Albert W. Scribner, 6 Country Club Rd., Darien, Conn. 06820

[21] Appl. No.: 15,226

[22] Filed: Feb. 26, 1979

[51] Int. Cl.[3] ..... B65H 17/36; B65H 17/44

[52] U.S. Cl. ..... 83/225; 83/250; 83/277; 226/115; 226/150; 226/162

[58] Field of Search ..... 226/115, 150, 162-166; 83/225, 250, 277; 91/356

[56] References Cited

U.S. PATENT DOCUMENTS

| | | | |
|---|---|---|---|
| 2,803,335 | 8/1957 | Powers | 226/166 |
| 3,847,320 | 11/1974 | Scribner | 226/115 |
| 4,051,987 | 10/1977 | Scribner | 226/115 |
| 4,195,761 | 4/1980 | Scribner | 251/230 X |

*Primary Examiner*—J. M. Meister

[57] ABSTRACT

A pneumatically operated feeder for punch presses and the like and having a feed slide that is adapted to be moved automatically through successive feed and index strokes. Instead of using a limit switch type device for sensing for the physical presence of the feed slide when the latter has reached the end of an operative stroke thereof, an improved control means is provided to identify the completion of such an operative stroke and to thereby cause said feed slide automatically to initiate its next operative stroke. When pressure fluid is applied to the main fluid motor of the feeder in order to produce say an index stroke of the feed slide the effective fluid pressure in said motor will not normally reach line pressure until after completion of said index stroke. Recognizing this operating condition exists in the feeder pressure sensitive means are provided for so identifying the completion of said index stroke, and valve means responsive to the operation of said pressure sensitive means are provided for causing said feed slide automatically to initiate a feed stroke after completion of said index stroke.

19 Claims, 7 Drawing Figures

PNEUMATIC STOCK FEEDER FOR PUNCH PRESSES AND THE LIKE

BACKGROUND OF THE INVENTION

In certain conventional type pneumatic punch press feeders control circuits have been used to automatically trigger a feed stroke of the feed slide in response the completion of an index stroke thereof and vice versa; however these control circuits utilize limit switches for sensing for the physical presence of the feed slide when the latter has arrived at the end of one or both of said strokes. One of the difficulties associated with this type of sensing arrangement is that the limit switch means must be positionally adjustable for accommodating different positional limits desired for the end of one or both of said strokes as is required where different feed stroke lengths of the feeder are desired. This condition necessitates not only an adjustable mounting for the limit switch type sensing means but also requires that the circuit connections between said adjustable limit switch sensing means and the remaining portions of the control system be flexible or otherwise adjustable so as to accommodate the said adjustable positionment of one or both of said limit switch means. These requirements can cause practical set-up difficulties, particularly where the sensing means must be installed near an extreme longitudinal end of the feeder and loose and cumbersome circuit tubing and/or other control interconnections must be maintained therewith to accommodate the remote and required adjustable positionment of said sensing means.

The principle object of the present invention is to provide a novel pressure sensing arrangement for controlling the automatic reversal of operative movement of the feed slide in a pneumatically operated punch press feeder.

Another object of the invention is to provide an improved pneumatic feeder having control means for controlling the automatic initiation of the next operative stroke of the feed slide thereof whereby no positional adjustment is required for said control means for different feed stroke lengths of said feeder.

Another object of the invention is to provide a pneumatically operated feeder for punch presses and the like having a reciprocable feed slide and wherein the effective fluid pressure in the fluid motor for actuating the feed slide is sensed in order to determine when one operative stroke of the feed slide has been completed and to initiate a signal in response thereto so as to cause initiation of the next operative stroke of said feed slide.

A further object of the invention is to provide a novel single feed slide type pneumatic feeder having an improved control means which when operated is adapted to cause the feed slide to automatically partake of a plurality of successive feed strokes.

Other objects of the invention will become apparent as the disclosure progresses.

SUMMARY OF THE INVENTION

The present invention affords an improved technique for controlling the automatic reversal of motion of a reciprocable punch press feeder slide. Here the completion of one of the operative strokes of the feed slide is sensed not by determining the physical presence of the slide at a particular location at the end of said one operative stroke but rather by sensing for a particular effective elevated fluid pressure in the main fluid motor cylinder, which elevated pressure is normally generated only when the feed slide completes said one operative stroke.

In the pneumatic system described herein a fluid motor is utilized to move the slide in an index direction against the continuous action of a biasing means, such as a mechanical spring, fluid pressure, etc. The effective fluid pressure in said fluid motor during the index stroke does not rise to full line pressure until after the index stroke has been completed, i.e., until the feed slide engages a fixed stop at the end of said index stroke. Thereafter pressure fluid from the supply line will further fill said fluid motor so as to cause the effective operative pressure therein to finally rise to full line or source pressure. A pressure sensing means that is sensitive to this final pressure rise is provided and may be coupled to an associated valve means which is adapted to cause the initiation of the said next feed stroke of the feed slide. By incorporating a pressure sensing means in this manner in the feeder control no limit switch type sensing means and no adjustable tubing or interconnecting means therefor are required. Thus the present pressure sensitive means and associated valve means may be built into the main body of the feeder and never needs positional adjustment for any changes in the feed stroke length set for the feeder.

DETAILED DESCRIPTION OF THE INVENTION

The disclosure in my copending U.S. patent application Ser. No. 910,840, filed May 30, 1978, for Stock Feeder for Punch Presses and the Like, now U.S. Pat. No. 4,195,761, is incorporated herein by reference and any and all parts herein described and/or illustrated in connection with the specifications and/or the drawings hereof are, unless otherwise indicated, similar to those parts correspondingly numbered, shown and/or described in said copending application.

Figure 1:
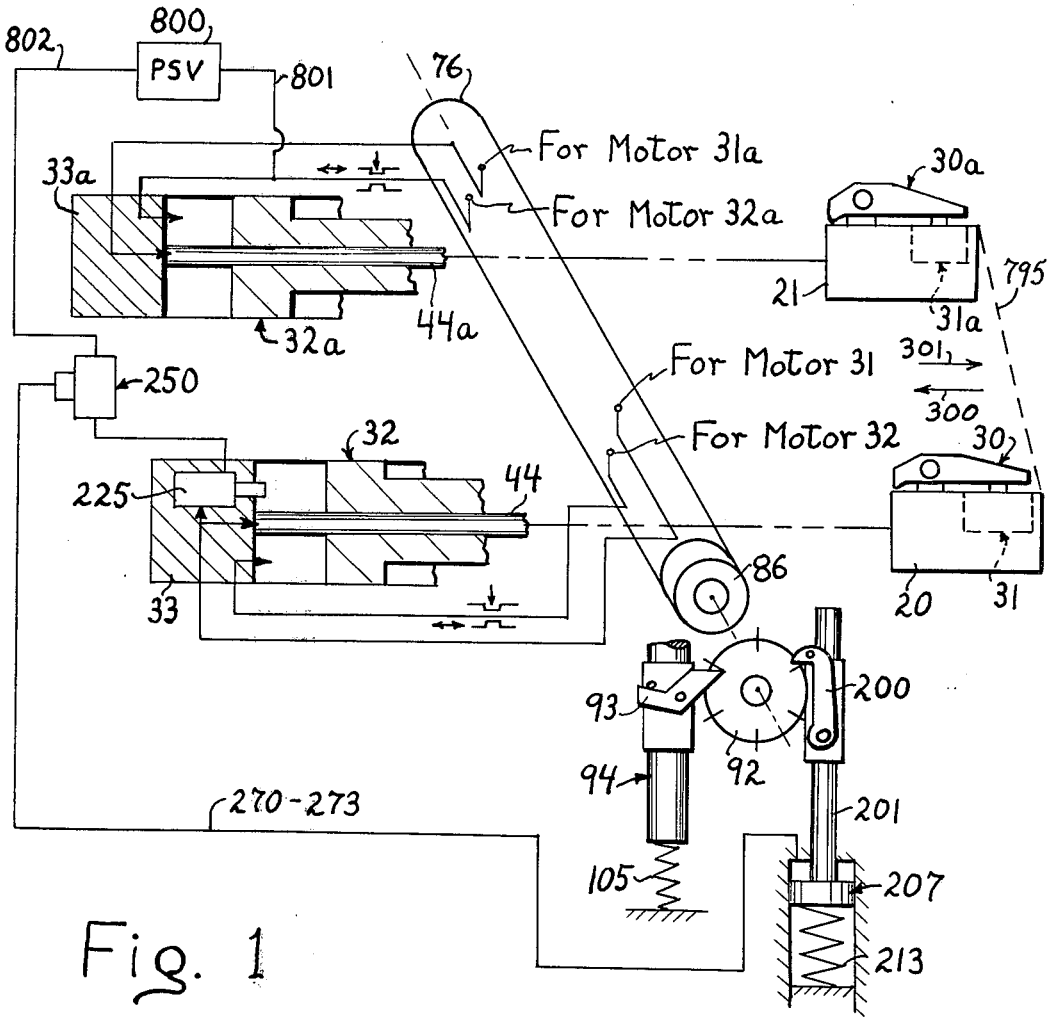
FIG. 1 is a schematic view of a pneumatically operated feeder and the present improved control means therefor.
Figure 2:
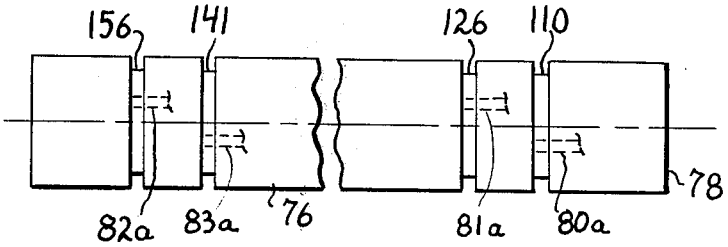
FIG. 2 is a side elevational view of the main valve plug in somewhat diagrammatic form. (For ease of illustration the O-ring seals for plug 76 have been omitted from this figure.)
Figure 3:
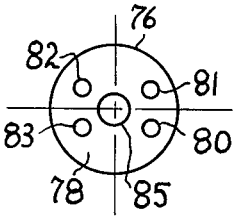
FIG. 3 is an end elevational view of the stationary face of the main control valve plug for the present feeder.
Figure 6:
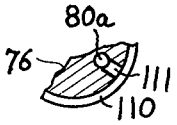
FIG. 6 is a fragmentary cross sectional view taken in the plane of the valve plug groove 110.
Figure 7:
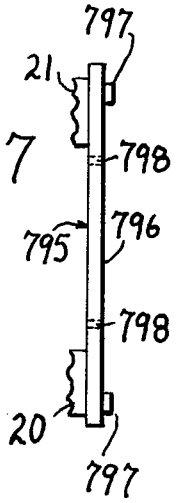
FIG. 7 is a fragmentary plan view illustrating the interconnection between two previously separate feed slides so as to form effectively a single feed slide.

Referring to FIG. 1 herein there is shown a schematic sketch that corresponds to FIG. 22 of said copending application. Two essential changes are made herein from the feeder control system illustrated in said FIG. 22 as will now be described. The first change, involving the main valve plug 76, is provided in order to cause the two feed slides 20 and 21 to move together as one and in mutual phase relation, i.e. both feed slides partake of a feed stroke together at the same time in response to the positionment of the main valve means in one operative condition thereof, and both slides partake of an index stroke together at the same time when said main valve means is positioned in another operative condition thereof. Thus the two feed slides 20, 21 are caused to move in unison and these slides are fixedly secured to one another by any suitable structural interconnecting means as is diagrammatically indicated at 795 of FIG. 1. As illustrated in FIG. 7 the feed slides may be secured together by a bar 796 that is fastened to said slides by means of screws 797; there being a plurality of holes 798 provided in the bar to permit the same lateral adjustment of said slides 20, 21. Thus the slides 20, 21 herein effectively constitute a single feed slide and hence they are referred to herein as such. In order to produce this movement in unison of the slides the hole or fluid line arrangement in the valve plug 76 is slightly changed as will now be described in connection with FIGS. 2 and 3. Here the plug 76 is drilled so that the valve port 80, FIG. 3, communicates with the groove 110 through lines 80*a* and 111 as is illustrated in FIG. 2 and in FIG. 6. In similar fashion valve ports 81, 82 and 83 communicate with grooves 126, 156 and 141 respectively as is diagrammatically illustrated at 81*a*, 82*a* and 83*a*, respectively, of FIG. 2. In this manner fluid pressure may, for one operative position of the rotary valve member 86, be directed into valve ports 80 and 83 simultaneously and thus into the head ends of said main fluid motors 32 and 32*a* so as to move the feed slide 20, 21 in an index direction 301, FIG. 1; both valve ports 81 and 82 at this time being connected to the valve exhaust line 85, FIG. 3, thereby exhausting gripper motors 31 and 31*a* so that the stock gripping means 30, 30*a* are in their stock release positions during said index stroke of feed slide 20, 21. When the said rotary valve member 86 is rotationally stepped to its next operative position the reverse pressure conditions will respectively exist at each of the valve ports 80–83 and hence fluid motors 31 and 31*a* will be charged with pressure fluid while the head ends of the main fluid motors 32 and 32*a* will be exhausted so as to thereby produce a feed stroke of said feed slide in the feed direction 300, FIG. 1.

If only the above described change in the control arrangement was made then the feed slide would partake of a feed stroke in response to the actuation of control plunger 94 and would, in response to the completion of this feed stroke, move through an index stroke to an indexed position where it would remain until the next actuation of plunger 94. Here there could not be an automatic initiation of a feed stroke by said slide in response to the completion of an index stroke thereof because there is now no means present to sense the arrival of the feed slide at the said indexed position. Where an automatic initiation of a feed stroke in response to the completion of an index stroke is desired in order to make the single feed slide capable of producing a plurality of feed strokes for each cyclic operation of the control plunger 94, there are provided means to sense when the feed slide completes an index stroke and means operated by the sensing means to control the shifting of the main valve to its next operative condition so as to automatically initiate the next feed stroke of said feed slide. The provision of these means involves the second of said two essential changes to be made in the feeder control system or arrangement as will now be described.

Figure 4:
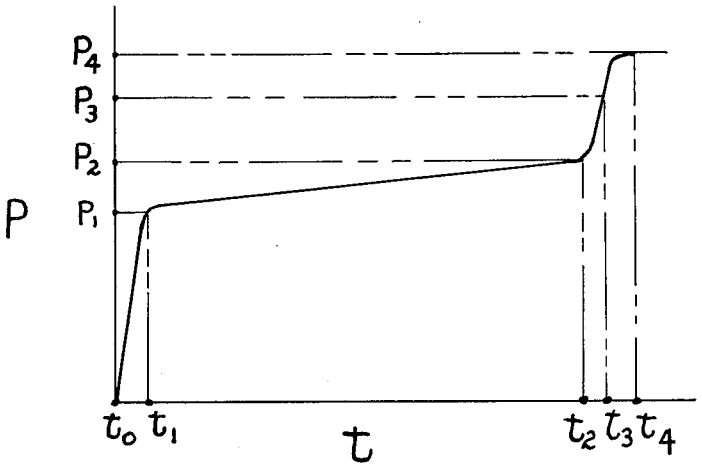
FIG. 4 is a graph illustrating the pressure rise in the present main fluid motor means of the feeder during an index stroke of the feed slide thereof.

Reference will be made first to FIG. 4 which is a graph that illustrates the varying levels of the effective fluid pressure (P) existing in the head ends of the fluid motors 32 and 32*a* after pressure fluid is first applied thereto; this graph illustrating a pressure condition which is created in said fluid motors at the completion of an index stroke and which may be used to trigger the next feed stroke of the feed slide. It will be noted that with the feed slide in its left hand position as seen in FIG. 1, when pressure fluid is applied to the head ends of said fluid motors 32, 32*a* the pressure P will rise rapidly from time t0 to time t1. When said pressure reaches P1 at t1 the feed slide (which is continously biased in feed direction 300 by the continuous presence of pressure fluid in the rod ends of said fluid motors 32 and 32*a*) will commence to move in an index direction 301, FIG. 1, against the said biasing action, and during the index stroke thereof from t1 to t2 the said effective pressure P will rise relatively slowly to P2. After the index stroke of slide 20, 21 is completed at t2 the pressure P rises rapidly again until at time t4 it reaches P4 which is the full supply line pressure that is applied to the feeder. The rapid rise in pressure from P2 to P4 thus indicates the completion of an index stroke and this higher pressure level may be sensed and used to control initiation of the next feed stroke by the feed slide. Accordingly a pressure sensitive valve means is provided which is sensitive to a fluid pressure higher than P2 and near P4, for example P3 shown in FIG. 4. Such a pressure sensitive valve means, schematically illustrated at 800, of FIG. 1, is connected by an input line 801 so as to be controlled by the control line to the head end of the main cylinder 32*a*. The output line 802 of the pressure sensitive valve means 800 is effectively connected to one input end of the shuttle valve 250; the reverse valve 225*a* of said FIG. 22 of said copending application and its associated parts and passages being eliminated from the plug 33*a* for the motor 32*a*.

With the control arrangement illustrated in FIG. 1 it will be seen that an index stroke of the feed slide may be initiated under the control of the reverse 225 and in response to the completion of a feed stroke thereof in the manner described in said copending application, while a feed stroke thereof may be initiated under the control of the pressure sensitive valve means 800 and in response to the completion of an index stroke by said feed slide. With this bidirectional type of control the feed slide may now be controlled so as to automatically partake of a plurality of feed strokes in response to each cyclic actuation of the control plunger 94 by the press with which the present feeder is to be used.

Figure 5:
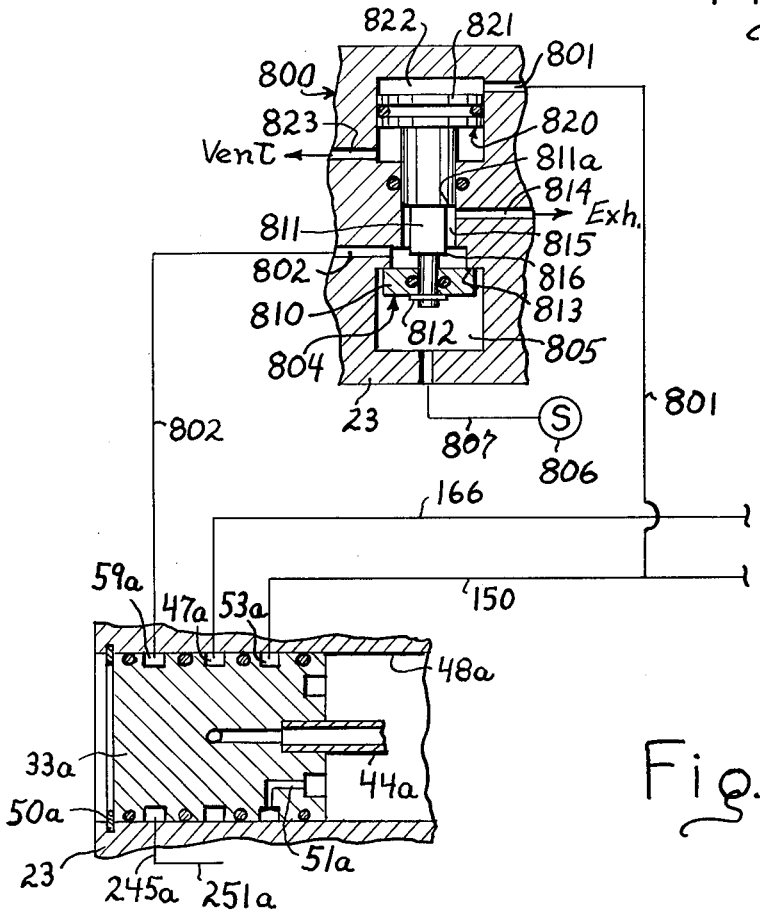
FIG. 5 includes an axial sectional view showing the details for the pressure sensing means and related valve means as well as for the plug 33*a* of the present feeder control arrangement, and further schematically illustrates the interconnections between the said sensing and related valve means and the said plug in said control arrangement.

The details of the construction and arrangement for the pressure sensitive valve means 800 are illustrated in FIG. 5 and will now be described. The plug 33*a* as previously mentioned has eliminated therefrom the former reverse valve (225*a*) and the fluid conduit lines immediately associated therewith. Thus the control lines 166 and 150 communicating between the main valve and the plug grooves 47*a* and 53*a* control as before the operation of said fluid motors 31*a* and 32*a* respectively as is more fully described in said copending application. The output groove 59*a* of plug 33*a* communicates not only through lines 245*a*, 251*a*, shuttle valve 250 etc. with the power pawl motor 207 as before, but also with the said output line 802, FIGS. 1 and 5, of the pressure sensitive valve means 800. The input control line 801 to the valve means 800 is connected to the said control line 150 for the head end of the fluid motor 32*a* as is indicated in FIG. 5.

The pressure sensitive valve means 800 includes a normally exhausting three way valve 804 that includes a valve chamber 805 that is adapted to be continuously supplied with pressure fluid from a source 806 through a line 807; the source 806 having a pressure level of P4, i.e. equal to the line pressure that is operatively applied to the feeder. The upper end of the valve chamber 805 is adapted to be closed by a valve disc 810 that is slidably carried on the lower end of a valve stem 811; the disc being provided with a suitable internal O-ring and being retained on the lower end of said stem by any suitable means such as an "E-clip" fastener ring 812 secured to the lower end of said stem 811. The disc 810 is adapted to normally valvingly seat against the shoulder 813 of the valve body 23 so as to prevent pressure fluid from passing from supply chamber 805 into the valve output line 802; the line 802 normally communicating with the valve exhaust line 814 through an intermediate chamber 815 that is coextensive with said chamber 805. When the valve stem 811 is moved downward from its normal FIG. 5 position and relative to disc 810 the shoulder portion 811*a* thereof will first move past and block the inner end of the exhaust line 814 and thereafter stem shoulder 816 will engage the disc 810 and displace the latter downward so as to allow pressure fluid from chamber 805 to flow into said output line 802. When the valve stem 811 moves upwardly disc 810 will first seat again in its said normal FIG. 5 position and thereafter further upward movement of stem 811 will cause stem shoulder 811*a* to uncover the inner end of said exhaust line 814 so that pressure fluid may again exhaust from output line 802 to said exhaust line 814. The pressure fluid in chamber 805 with bias stem 811 to its normal upper or FIG. 5 position as determined by engagement of the fastener ring 812 with the lower surface of disc 810.

The above described operation of the three way valve 804 is adapted to be produced by a fluid motor 820, FIG. 5, that is arranged so as to in effect constitute a pressure sensing means. Here the upper end of valve stem 811 is connected to a piston 821 that is axially movably disposed in a cylinder 822; the upper or head end of said cylinder communication with said input control line 801 while the lower or rod end thereof is vented through a line 823. The effective diameter of piston 821 is made only slightly greater than the effective diameter for the valve disc 810 so that the fluid pressure in the upper end of cylinder 822 (which pressure through input line 801 reflects the pressure in the head ends of the fluid motors 32 and 32*a*) will have to reach a value of at least P3, FIG. 4, before the piston 821 will downwardly unseat the valve disc 810 from its said normal FIG. 5 position. In that the three way valve 804 is thus operated only after an effective fluid pressure of at least P3 has been reached and this pressure as stated in connection with FIG. 4 occurs only after completion of an index stroke, then when said index stroke is completed the valve 804 will be opened as just described so as to initiate an output pressure fluid flow in line 802 which through shuttle valve 250 etc. will operate the power pawl motor 207 so that the main rotary valve member 86 will be stepped to its next operative rotary position and a feed stroke of said feed slide will thus be automatically initiated.

The above described control arrangement can be used to cause the feed slide 20, 21 to repeatedly move through a continuing succession of feed and index strokes, the desired number thereof being determined by the number of effective teeth on the ratchet wheel 92, etc. as explained in said copending application. In this way the present feeder which has effectively only one feed slide, instead of two as provided in the feeder of said copending application, is adapted to automatically execute two or more stock feed strokes in response to each cyclic operation of the control plunger 94 as produced by the motion of the press ram.

The above described arrangement affords a simple, compact and relatively inexpensive pressure sensitive control system for automatically producing a plurality of successive operative strokes by a simple feed slide in response to each cycle of operation of the press.

I claim:

1. In a pneumatically operated feeder for intermittently advancing stock into the work station of a punch press or the like and having:

a frame;

feed slide means carried by said frame for reciprocating movement through operative feed and index strokes between feed and index positions;

stock gripping means carried by said feed slide means;

fluid motor means for actuating said feed slide means between said positions; and valve means for controlling the operation of said fluid motor means and thus the reciprocating movement of said feed slide means; the improvement comprising control means, including pressure sensitive means for sensing the effective fluid pressure in said fluid motor means during one operative stroke of said feed slide means, for controlling the operation of said valve means so as to cause the initiation of the next operative stroke of said feed slide means in response to the completion of said one operative stroke thereof.

2. Apparatus as defined by claim 1 wherein said pressure sensitive means is adapted to be operatively triggered when the effective fluid pressure in said fluid motor means approaches the full line fluid supply pressure that is applied to said feeder.

3. Apparatus as defined by claim 1 or 2 wherein said next operative stroke is a feed stroke of said feed slide means, and wherein said one operative stroke is an index stroke of said feed slide means.

4. Apparatus as defined by claim 1 or 2: additionally comprising means for sensing the completion of said next operative stroke of said feed slide means and for causing initiation of the next following operative stroke of said feed slide means.

5. Apparatus as defined by claim 4 wherein said control means including said pressure sensitive means is adapted to produce a predetermined plurality of feed strokes of said feed slide means for each cycle of operation of said press.

6. Apparatus as defined by claim 1 or 2 wherein said pressure sensitive means includes a piston.

7. Apparatus as defined by claim 6 wherein said control means includes a normally exhausting valve.

8. Apparatus as defined by claim 1, or 2 wherein said control means includes a ratchet wheel.

9. Apparatus as defined by claim 1 or 2 wherein said fluid motor means for actuating said feed slide means includes a pair of fluid motors.

10. Apparatus as defined claim 1 or 2 wherein said one operative stroke is an index stroke of said feed slide means.

11. In a pneumatically operated feeder for intermittently advancing stock into the work station of a punch press or the like and having:

a frame;

a feed slide carried by said frame for reciprocating movement through operative feed and index strokes between feed and index positions;

stock gripping means carried by said feed slide;

fluid motor means for actuating said feed slide means between said positions, said fluid motor means including a cylinder having a rod end and a head end, and a piston and a piston rod, said piston rod being connected to said feed slide;

valve means for controlling the operation of said fluid motor means and thus the reciprocating movement of said feed slide, said valve means being shiftable to a plurality of operative conditions: the improvement comprising a first control means operative to cause said valve means to be shifted to one of its said operative conditions so as to produce an operative stroke of said feed slide; and a second control means, including pressure sensitive means for sensing the effective fluid pressure in said cylinder, operative to cause said main valve means to be shifted to another one of its said operative conditions so as to cause the automatic initiation of the next operative stroke of said feed slide.

12. Apparatus as defined by claim 11 wherein said pressure sensitive means is adapted to be operated when the effective fluid pressure in the head end of said cylinder approaches the full line fluid supply pressure that is applied to said feeder.

13. Apparatus as defined by claim 12 wherein said second control means is adapted to be operated in response to the completion of an index stroke of said feed slide.

14. Apparatus as defined by claim 11 wherein said second control means is adapted to be operated in response to the completion of an operative stroke of said feed slide.

15. Apparatus as defined by claim 14 additionally comprising a third control means operative to cause the operative condition of said main valve means to be shifted in response to the cyclic operation of said punch press.

16. Apparatus as defined by claim 15 wherein said first control means is adapted to be operated in response to the completion of a feed stroke of said feed slide, and wherein said second control means is adapted to be operated in response to the completion of an index stroke of said feed slide.

17. Apparatus as defined by claim 15 or 16 wherein said control means include a means for controlling the number of feed strokes executed by said feed slide means for each operation of said third means.

18. Apparatus as defined by claim 11 or 12 wherein said first and second control means includes means to produce a predetermined plurality of feed strokes of said feed slide for each cycle of operation of said press.

19. Apparatus as defined by claim 11 or 12 wherein said fluid motor means includes a pair of fluid motors.

* * * * *